United States Patent [19]

Siegler

[11] 4,060,384

[45] Nov. 29, 1977

[54] MANUFACTURE OF LEATHER

[75] Inventor: Marcel Siegler, North Bergen, N.J.

[73] Assignee: Seton Company, Newark, N.J.

[21] Appl. No.: 721,706

[22] Filed: Sept. 9, 1976

[51] Int. Cl.[2] ..... C14C 3/06; C14C 3/28

[52] U.S. Cl. ..... 8/94.27; 8/94.2; 8/94.19 R

[58] Field of Search ..... 8/94.27, 94.19, 94.2

[56] References Cited

U.S. PATENT DOCUMENTS

| | | | |
|---|---|---|---|
| 3,010,779 | 11/1961 | Komarek et al. | 8/94.18 |
| 3,104,151 | 9/1963 | Windus et al. | 8/94.33 |
| 3,253,879 | 5/1966 | Komarek et al. | 8/94.26 |
| 3,254,938 | 6/1966 | Rodriguez et al. | 8/94.27 |
| 3,475,113 | 10/1969 | Sellet | 8/94.24 |
| 3,480,379 | 11/1969 | Lipowski et al. | 8/94.24 |
| 3,888,625 | 6/1975 | Dawson | 8/94.27 |

*Primary Examiner*—John Kight, III

*Attorney, Agent, or Firm*—Connolly and Hutz

[57] ABSTRACT

Manufacture of grain and split leather is simplified by pre-tanning hide with a chromium-free tan until its shrinkage temperature is about 170° to about 185° F, splitting the pre-tanned hide to provide a grain intermediate and a split intermediate, shaving at least one of these intermediates, and chrome-tanning the shaved intermediate. Shavings contain no chromium and can be disposed of by dumping, without significant environmental impact. Before splitting, the hide can also be pickled to improve the splitting and shaving and make the unfinished hide better suited for shipping to remote geographical areas. Entire hide treatment sequence can be effected with two stages in which batches of hides are loaded in a container such as tumbling drum; unhairing, bating and pre-tanning with or without a pickle, all in one stage, and final tanning, coloring and fat-liquoring in another stage. Final chrome-tanned product has very good physical characteristics including unusually high slot tear and is recovered in higher yield.

14 Claims, No Drawings

MANUFACTURE OF LEATHER

The present invention relates to the manufacture of leather such as is used for shoes, upholstery, garments, and the like.

Among the objects of the present invention is the provision of novel leather manufacturing processes as well as improved leather made by such processes.

The foregoing as well as additional objects of the present invention will be more fully understood from the following description of several of its exemplifications.

According to the present invention the manufacture of grain and split leather from a hide such as a cattle hide, is improved by subjecting the hide to a pre-tanning with an essentially chromium-free tan until its shrinkage temperature is about 170° to about 185° F, then splitting the pre-tanned hide to provide a pre-tanned grain intermediate and a pre-tanned split intermediate, shaving at least one of these intermediates to give it a more uniform caliper, and chrome-tanning the shaved intermediate.

The foregoing procedure is of particular advantage in the making of chrome-tanned grain leather. The shaving removed after splitting and before chrome-tanning are not contaminated with chromium and can accordingly be disposed of as by dumping, without environmental pollution problems. Leachings from such dumped shavings do not contain any material amounts of stream-polluting ingredients, and can be permitted to run off directly into streams.

Any trimmings cut from the hide before chrome-tanning are similarly free of chromium and can also be disposed of by dumping.

The pre-tanning of the hide also greatly reduces the putrefaction of the above-described dumped materials.

The pre-tanning of the present invention is normally effected on cattle hides or the like after unhairing and bating, and these three steps along with the associated washings and the like can be carried out on a charge of hides in a single container, without requiring the removal of a hide from the container until the pre-tanning is completed. The hides can also be pickled before, during or after pre-tanning, while the hides are in the container, and such pickling with or without the pre-tanning places the hides in condition for shipment to remote geographic locations requiring many weeks en route, without danger of material deterioration. Hides pickled or pickled and pre-tanned are preferably wrapped in waterproof plastic sheeting for such shipment to keep them from drying out.

Splitting of the pre-tanned pickled hides is also effected more uniformly and both the grains as well as the splits so made are much closer to the desired weights.

Inasmuch as the marketing features of grain leather are quite different from those for split leather, the grain and split intermediates of the present invention are preferably given different final tannings, and these final tannings can be performed in different parts of the world. Where both of these intermediates are subsequently chrome-tanned they can both be shaved before chrome-tanning and before shipping to improve the disposability of the shavings from both intermediates.

When making the heavier leathers, such as those weighing more than 4 ounces, shaving can be minimized or completely eliminated inasmuch as many heavy leathers have a wide caliper tolerance.

The chrome-tanned leather products produced by the foregoing technique have a particularly high slot tear, usually above 13 for 2½ to 3 ounce leather, so that they are very desirable for uses where they are subject to tearing influences. In addition to this highly advantageous feature the leather products of the present invention have somewhat better tensile strength, a better break, and fuller flanks as compared with prior art chrome-tanned leathers.

The improved physical characteristics appear to be contributed by the combination of the divided tanning sequence with the splitting and shaving. The splitting and shaving operations are fairly severe mechanical treatments, and carrying them out after a pre-tanning reduces the severity of their mechanical effects on the hide fibers. Also the final chrome-tanning is carried out on a substrate which is relatively thin and which has been stretched as a result of the splitting and shaving, so that the chrome-tanning is more effective. Indeed there is generally no great need for repeating the chrome-tanning, so that the expense of a second chrome-tanning so often used in the prior art, is reduced.

The relatively small amount of chrome-tanning needed pursuant to the present invention is accentuated by the fact that the chrome-tanning chemicals are used only on a shaved substrate, so that the total amount of these chemicals is further reduced in proportion to the weight of the shavings. The recycle and reuse of the chrome-tanning chemicals is also diminished. The cost of chrome-tanning chemicals is generally the most expensive chemicals purchase for a tannery, and the disposal of spent chrome-tanning liquors is the most troublesome.

The stretching action referred to above also increases the quantity of leather produced from a hide, when the leather quantity is measured by its surface area. This increase is 3% or more as compared to that of a standard lime-splitting, or over 5% as compared with the prior art blue-splitting tanning sequence.

The individual steps of the process of the present invention can be carried out in the same way those steps are conventionally conducted in the prior art. However the shaving step in the process of the present invention requires extra care if it is conducted on pre-tanned hides that have not been pickled. Hide shaving equipment generally has an adjustable automatic feeding system that controls the speed with which the hide is moved past a rapidly rotating set of spiral knife edges, and the feeding system is adjusted to a feed of 45 or fewer feet per minute for best shaving of unpickled grains or splits pursuant to the present invention. At higher feed speeds there is a tendency for a pre-tanned unpickled grain or split to be pulled by the spiral knife edges and improperly shaved, particularly those grains or splits less than about 60 mils thick.

Pre-tanned pickled grains and splits in accordance with the present invention are however very effectively shaved at any desired feed speed, even 55 or more feet per minute, without problems and regardless of caliper. Fat-liquoring the grains and splits to a pick-up of about ¼ to about ¾% fat-liquor oil during or after pre-tanning and before shaving, also helps the shaving.

The following examples illustrate the present invention. Unless otherwise noted all water is tap water.

EXAMPLE 1

Ten pre-fleshed brine-cured heavy steer and cow hides originally weighing a total of 665 lbs. and already beamed (soaked and unhaired) are bated in a 4 by 8 feet rotatable wood hidetreating tumbling drum. The end pH of the bating liquor was 7.4 (starting pH 8 as determined by phenolphthalein) and the final temperature 89° F. The used bating liquor is drained, the hides washed 15 minutes with a stream of 75° F water flowing into the drum at 100 gallons/minute without removing the hides from the drum, the wash water drained and the following sequence is conducted:

a. Add 19 gallons 80° F water, then 60 pounds ordinary salt (or equivalent brine), 7½ lbs. sodium formate and 12 oz. of bromohydroxyacetophenone, biocide, and then run the tumbling drum 10 minutes.

b. Stop the drum to make Salimeter reading and verify a 28° value, if necessary adjusting to this value by addition of more salt, sodium formate or water, then start the drum again, add 3¾ lbs. formic acid that had been diluted with 5 gallons of water, and after 30 minutes of running stop the drum. At this point the pH of the liquor is about 5.3.

c. Add 11¼ lbs. of HELATAN 9501, which is about an equal proportion mixture of sulfonated phenol-formaldehyde pre-tan and glutaraldehyde pretan, diluted beforehand with 5 gallons of 80° F water, and then run the drum for 30 minutes.

d. Add 3¾ lbs. of non-ionically emulsified blend of raw and synthetic fat-liquor stable in the presence of the acid electrolyte and having a pH of 5.5 – 6, and run the drum 30 more minutes. The oil of this fat-liquor will give internal lubrication during syntan pre-tanning, and helps with the splitting and shaving.

e. Add slowly 7½ lbs. of formic acid (or of 95% sulfuric acid) diluted with 10 gallons of water, and then run the drum an additional hour.

f. At this point, the pH of the liquid is 2.8 to 3 and temperature 83° F. Cut small samples from the hides and test them in an automatic shrinkage testing machine to determine their shrinkage temperature, the samples being immersed in water whose temperature is raised 5° F per minute. In this case shrinkage starts at 176° F.

g. Then the hides are dumped from the drum, and stretched over horses overnight.

h. The next morning the hides are removed from the horses, split according to the tannery requirements, then wrung, after which the grains and the splits are both shaved. The splitting is adjusted to give 4½ – 5 oz. splits, and the shaving of the grains to give 2½ – 2 oz. product. The splits are shaved for 4½ – 5 ounces. For both the grains and the splits the shaver feed is about 55 feet per minute. The total weight of the grains is now 166 lbs., and of the splits 110 lbs. The splits which at this point are pre-tanned and pickled, are ready for further processing or for shipment, and the shavings are dumped.

i. The chrome-tanning is carried out in a smaller tumbling drum. Into the empty drum there is added 12 gallons of 100° F water, 3½ lbs. ordinary salt, and 13 oz. sodium formate.

j. The shaved grains are then loaded into this drum and the drum operated for 10 minutes.

k. Then one pound of formic acid diluted with 1 gallon of water is added, the drum is operated ½ hour.

l. The drum is stopped, 15 lbs. of commercial basic chromium sulfate containing 23.5 chromic oxide equivalent, is added, and the drum then operated for two hours.

m. Then 13 oz. of sodium bicarbonate dissolved in 1 gallon of 90° F water, is added in two equal feeds 30 minutes apart.

n. The drum is again operated for 1 hour, leaving the pH at 3.6 and the temperature 104° F. Samples cut from the grains now show no skrinkage of area when immersed in boiling water for 2 minutes. The liquor is now drained from the drum unless the samples do not pass the shrinkage test, in which event the drum is operated for an additional 30 minutes before draining the liquor. Additional sodium bicarbonate can be added, but not to bring the pH higher than 3.8.

o. At this point the chrome-tanning is completed, and the grains are very smooth. Continue in the same drum with the coloring procedure according to the tannery needs (type of leather and color requirements).

p. For instance, the leather is first washed with 90° – 100° F water for 15 minutes. Then aqueous sodium bicarbonate or other neutralizing agent (e.g. ammonium bicarbonate, sodium formate, etc.) is added to bring the pH to 4.8 – 5.5.

q. The drum contents are again washed for 15 minutes with 110° – 120° F water, the washings drained, then 25 gallons 130° F water (100% float) are added followed by 12 oz. of nonionic synthetic fat-liquor stable to electrolyte, mixed in 2 gallons 130° F water.

r. The drum is now run for 30 minutes and there is then added ½ lbs. brown aniline dye which is 1:1 mixture of acid and direct dye dissolved beforehand in 170° –180° F water and diluted to make 1½ gallons 130° solution.

s. The drum is run for 30 additional minutes, then add ½ lb. formic acid in ½ gallon of cold water and the drum is run for 15 minutes more.

t. A sample of the dyed product is now checked to verify the shade and uniformity of color, and if necessary additional dye is added and the drum run 15 minutes to ½ hour longer.

u. Drain the used dye liquor, washed the dyed leather 15 minutes with 130° F water, then add water to the 100% float level, and add a prepared fat-liquor mixture of 5 lbs. synthetic sperm oil, 5 lbs. sulfated neat's-foot oil and ½ lb. raw neat's-foot oil, emulsified in 4 gallons of 130° F water. Run the drum for 1 hour, check the oil exhaust and the leather to make sure the liquor is clear and the leather is not oily.

v. Drain the liquor, wash the fat-liquored leather with cold water for 5 to 10 minutes, unload the drum, and stretch the unloaded leather onto drying racks.

The pre-tan in Example 1 of U.S. Pat. No. 3,480,379 can be substituted for the pre-tan mixture of step (c), but is not as efficient. The shrinkage temperature tends to be lower and more pre-tan chemicals are generally needed.

For tanning the shaved splits of the foregoing example the chrome-tanning described in it (steps *j* through *n*) can be used though there can alternatively be used other mineral tanning methods such as with zirconium tanning chemicals and aluminum tanning chemicals as described in U.S. Pat. Nos. 3,423,162, 2,970,031 and 3,232,696, or glutaraldehyde tanning as described by Filachione and others in the Journal of the American Leather Chemists Association, Vol. 54, pages 488–502 and 668–674; Vol. 59, pages 281–292 and 378–402; Vol. 62, pages 507–522; Vol. 64, pages 227–239; and Vol. 70, pages 269–272, or vegetable tanning such as with quebracho, wattle, sumac or chestnut, as well as combined resin and syntan tanning such as described in The Chemistry of Leather Manufacture published by McLaughlin-Theis, Chapter 22 (pages 693–722), practical Technology by Thomas C. Thorstensen. Any of these tanning materials may be used singly or in combination with one another according to the type of leather to be produced. While chrome-tanning is greatly preferred for most leathers and is simple and convenient to carry out, the process of the present invention does not require that both the grains and the splits be chrome-tanned.

EXAMPLE 2

The sequence of Example 1 is repeated through its step (h), using a very small tumbling drum and a batch of 2 heavy native steer hides which after soaking weigh 135 pounds. All quantities of chemicals and water are reduced to 1/5 the amounts given in Example 1, except:

A. Step (b) is eliminated, the pH after step (d) is then about 6.8.

B. In step (e) 2½ lbs. 96% sulfuric acid (or 3½lbs. formic acid) diluted in 5 gallons water are added in two portions 20 minutes apart, and the drum is run for 1½ hours, stopped for 1 hour, and then run ½ hour further.

C. The shrinkage temperature after pre-tanning is about 177° F and the splitting and shaving adjusted to give a grain weighing 3½ – 3¾ oz. The shaved weight of the grains totals 52 lbs. and of the splits, shaved to 3½ – 4 oz., 20 lbs.

EXAMPLE 2A

For the grains produced in Example 2, the processing can continue with the loading of these grains into a small drum to which is then added:

3 gallons 75° F water
1 lb. salt
8 oz. sodium formate
45 grams biocide (o-phenoxyphenol)

Run the drum for 10 minutes, then ¼ lb. formic acid in ½ gallon water is added and the drum is rotated for ½ hour. Add 4 lbs. of commercial basic chromium sulfate containing 23.5% chromic oxide equivalent and run the drum for 1 hour. Then ½ lb. cationic fat-liquor in ¼ gallon 120° F water is added and the drum run for 15 minutes. 1¼ pounds commercial glutaraldehyde tan (such as Relugan GTW50 or Chemtan A55) is added in three equal feeds 20 minutes apart, and the drum is then run for 2 hours. ¾ lb. sodium bicarbonate dissolved in 1 gallon 90° F water is then added in three equal portions 30 minutes apart, with the drum run in between and finally for another hour. At this point the temperature of the drum contents is 106° F, pH 3.7. Samples cut from the grain now show no shrinkage of area when immersed in boiling water for 2 minutes so that the tanning is not complete. The liquor is drained from the drum and stored in a tank for reuse, and the tanned product can be washed, and continued through the coloring process.

Further processing can be applied without removing the chrome-tanned product from the drum. One suitable procedure that can thus be used according to the present invention is to wash the chrome-tanned product with 110° F water for 10 minutes, then with the work at 100% float, add 6 gallons 110° F water followed by 1½ lbs. sodium acetate and ½ lb. sodium bicarbonate all dissolved in 3 gallons 110° F water, in three equal feeds 20 minutes apart, then run the drum for 40 minutes. At this point the pH is 4.9 – 5 and the product is washed for 10 minutes with 110° F water. The work is now restored to 100% float, and 6 gallons 110° F water, 8 oz. TAMOL SD. syntan, 1½ lbs. wattle and 2 lbs. phenolic syntan (type Basynthan DLE, Chemtan E17 to Trutan 1776K or other resins or vegetable extracts) are added, and the drum run for another 40 minutes. Then wash 10 minutes in 120° F water and continue with selected dye and fat-liquor procedure.

One effective finishing technique is to add 120° F water to 150% float, and 8 oz. of mixed direct and acid red dye (equal parts) dissolved beforehand in 170° – 180° F water and diluted to make 1 gallon of 130° F solution. Run the drum for 30 minutes and then add ¼ lb. of formic acid diluted in ½ gallon of water, and then run the drum again for 15 minutes. After the drum is stopped the work is checked for color shade and dye exhaust. The work is now washed for 10 minutes with 130° F water and drained. Now add 130° F water to 100% float level and add a prepared fat-liquor mixture of 1½ lbs. synthetic sperm oil, 1½ lbs. sulfated neat's-foot oil and 2½ lbs. of solvent oil (e.g. mineral spirits) emulsified in 3 gallons of 130° F water, and run the drum for 1 hour. Stop the drum for checking the oil exhaust and the leather to make sure the oil has been absorbed by the leather and the grain is not oily. Wash the leather for 10 minutes with 70° F water, unload, horse over-night and continue with the drying.

EXAMPLE 2B

The splits of Example 2 are loaded into a small trial size drum and given the following treatment:

I. Add 2 gallons of saturated brine, 0.1% (9 grams) biocide, and run the drum for 10 minutes.

II. Add in two equal portions 15 minutes apart 1.75% (5½ ozs.) 96% sulfuric acid diluted in 1 gallon water, running the drum between these additions and 1½ hours afterwards.

III. The drum is then stopped and rested for an hour, and at this point the pH is 1.7 – 1.8.

IV. Drain the drum and then add to it 1½ gallons chrome-tanning liquor recovered from a prior chrome-tanning run and containing 6 – 8 grams/liter chromium oxide (calculated as $Cr_2O_3$) and 3 ounces sodium formate.

V. Run the drum 1 hour, then add 1 lb. 3 ozs. commercial basic chromium sulfate containing 23.5% chromic oxide equivalent and then run the drum two additional hours. The chrome-tanning as well as the further process is continued as described in Example 1 (steps *m* through *v*), or by the following:

VI. 5 ozs. of sodium bicarbonate dissolved in 6 gallons of water is added in three portions (2 gallons every 30 minutes with intervening drum operation) and then continue running of the drum for another hour. At this point pH is 3.5, temperature 104° F. and sample cut from splits shows no shrinkage after 2 minutes in boiling water.

VII. The chrome-tanning liquor accumulated in the drum is now drained and pumped into a tank for recycle. The now fully tanned splits in the drum are washed for 10 minutes with 90° F water and can be colored and fat-liquored to a good suede split product. To make a final product having greater resistance to water, the fat-liquoring can be with the composition such as that of German Auslegeschrift 2 355 025.

EXAMPLE 3

Another run is made in a 4 by 8 foot tumbling drum with 20 heavy native steer hides weighing 1540 lbs. using the sequence of Example 1 with double the quantity of chemicals, but steps (a) through (e) are replaced by a pre-tanning run at 50% float, pH 7 to 8 and 85° F with 23 lbs. of a mixed sulfonated phenolalkylated phenol-formaldehyde condensate pretan. The drum is run for 45 minutes and rested for 30 minutes. Thr shrinkage temperature upon completion of this pre-tanning is 172° F. After chrome-tanning, retanning and fat-liquoring can be effected as in Example 2A to give a very good smooth full grain upper leather, upholstery and handbag leather. Splits very suitable for insoles, belting, laminating, etc. are prepared with such a sequence.

So-called shrunken leather can also be produced pursuant to the present invention. Thus after the pre-tanning, splitting, wringing and shaving, the grains are shrunk as by treatment with dihydroxy diphenyl sulfone resins as described by E. Komarek and G. Mauthe in U.S. Pat. No. 3,010,779, or with condensation products of diphenyl sulfone, formaldehyde and naphthalene sulfonic acid as described by S. S. Lipowski in U.S. Pat. No. 3,477,801. The shrunk intermediate can then be washed and given the final tanning with or without the finishing. The final product is fully tanned and has the heavier body characteristic of shrunk leather. It will be noted that this shrinking modification does not require any more loading or unloading stages.

EXAMPLE 4

The sequence of Example 1 is repeated with the following modifications. A small tumbling drum is used with a batch of two heavy native steer hides weighing a total of 130 lbs. and 1/5 the quantities of chemicals. After step (e) the pH is 2.9 and temperature is 86° F. Then 3 lbs. of commercial 50% glutaraldehyde tan is added, the drum run for 30 minutes and rested for 30 minutes. The shrinkage temperature is now 174° F and pH 3.4. The sequence of Example 1 is now resumed with step (g).

Any technique can be used to prepare hides for the pre-tanning of the present invention, and a discussion of such preparatory techniques is given in the Journal of the American Leather Chemists Association, Vol. 69, pages 28–43, 1974. The following is a preferred exemplification, all chemical percentages being based on the weight of the original fleshed hides.

EXAMPLE 5

Soaking

Pre-fleshed brine-cured hides are soaked for 5 to 6 hours in 70° – 80° F water, 100% float, containing 0.2% caustic soda. (Fresh hides can be fleshed and similarly soaked but only 2 hours of such soaking is then needed.) Simple rotating drums or Hide Processor drums or conventional Hagspiel or Corretan drum assembly or the like can be used for this soaking.

Unhairing

The soaking liquor is then drained, the hides washed with a second charge of 70° – 80° F water, and a third charge of water, 100% float, at 75° – 80° F is introduced, this water containing 1% sodium sulfhydrate flake. The drum is now rotated for one hour.

At this point the drum is stopped, 1.5% sodium sulfide plus 2.5% lime, are added and the drum run for an additional hour, after which the drum is stopped for 1¾ hours, then run for ¼ hour, this 2 hour stop-start sequence is repeated six more times, and the liquor then drained.

If the original hides are too greasy there can be added to the soak liquid or the dehairing liquid or to both, from 0.2 to 0.25%, of a degreasing agent, preferably an alkylphenyloxypolyethoxyethanol non-ionic such as Triton X114.

The unhairing liquor is now drained, and if a very soft leather is desired the hides can be relimed for at least 8 hours in 70° F water, 100% or more float, containing 1 – 3% lime.

Bating

The unhaired hides are washed for 10 minutes in a flowing stream of 85° – 90° F water, after which the hides are given a deliming treatment at 50% float in 90° F water containing 2½% of a mixture 30 parts ammonium sulfate, 40 parts ammonium chloride and 30 parts sulfophthalic acid. After ¼ hour of drum rotation in this liquor, the drum is stopped and 0.07% Oropon WN4 pancreatic bating enzyme added to the liquor and the drum run ¾ hour. At this point there is further added to the liquor 0.2% non-ionic degreasing agent such as referred to above, and 0.3% sodium bisulfite. The drum is then again run for 40 minutes to complete the bating process. The liquor which now has a pH of 8 to 8.3, is drained and the hides are washed 20 minutes with a stream of 70° –75° F water to wash out lime salts and cool down the treated hides. The product is now ready for the pre-tanning.

The treatment of any of the foregoing examples can now be applied. Alternatively the pre-tanning of Example 1 can be modified so that it is effected at a pH of 7.5 and can be followed by a separate pickling after the pre-tan liquor is drained. A suitable pickle treatment for this purpose is with 60% float water at 80° F, the water containing 2.5% sodium chloride, 1% sodium formate, 0.1% biocide, and after a 10 minute mixing run, 1 ½% formic acid or commercial pickling acid such as Picaltal, diluted in 10% water, is added and the drum run ½ hour. Where a little fat liquor is desired it can also be added to the pickle liquor at this point, and the drum run an additional ½ hour. Now 1% sulfuric or formic acid, pre-diluted in 10% water, is added and the drum run for another hour. The final pH of the pickle liquor is 3 to 3.2 and the hides are well pickled with their shrinkage temperature a few degrees higher than the shrinkage temperature before pickling. The product can be rinsed, split, wrung and shaved to continue with the process of the present invention. It should be noted, however, that the shrinkage temperature after post pre-tan pickling does not determine when the pre-tanning is completed, and for the purpose of the present invention the shrinkage temperature after pre-tanning is the criterion even if pickling precedes or is concurrent with pre-tanning.

Basically the prior art methods of making leather from cattle hide (upper leather, upholstery, garment, suede, etc.) as currently practiced are of two principal types. Either the hides are split following the unhairing when the hides still contain lime used for the unhairing (splitting in lime), or they are split after chrome-tanning (blue-splitting).

Each type of process has its advantages and disadvantages. Splitting in lime provides a finer grain, softer leather, lighter and more uniform color for aniline or semi-aniline leather as well as about 2% more yield and higher tanning capacity for the grain, along with the flexibility of leaving the splits not chrome-tanned, if desired. The splits can then be given any type of tan, for example vegetable tan or tanning combination to make products suitable for use as insoles, belts, suede, garment, etc.

On the other hand the blue-splitting process is a simpler and speedier procedure, with more rapid throughput and gives a tighter leather.

The present invention provides advantages of both the lime-split and the blue-split processes, and in addition requires a minimum amount of chrome-tanning chemicals.

Pre-tanning with a HELATAN 9501 type mixture is particularly desirable. The reaction between hide collagen and the phenolic hydroxyl and carboxyl groups of the syntans, and the formation of bridges between polypeptides chains of the collagen also effected by the syntans, contribute to increases in thermal stability and shrinkage temperature of the final chrome-tanned leather. More of the lyophilic groups in hide collagen are believed transformed into lyophobic groups by such a tanning sequence.

As recognized in the art and as shown in the works by Stiasny, Schaefer ad Their, Highberger and Retsch, Fein and Filachione, etc., syntans are essentially sulfonated phenolformaldehyde type condensates or carboxyl-group-containing resins, and either of these types makes a highly effective pre-tan in the process of the present invention.

As is well known the penetration and fixation of the different type of syntans and/or glutaraldehyde with the collagen is influenced by the temperature, concentration, chemical proportioning, and pH value of the hides during the pre-tanning operation. According to the present invention the syntan pre-tanning can be effected at pH 7.5 to 8.5 after the bating process, but gives better and faster penetration at lower pH such as 5.0 to 5.3 during pickling, or at even lower pH after pickling.

The effectiveness of the pre-tanning is determined by the shrinkage temperature after pre-tanning is completed. A shrinkage temperature below about 170° F shows not enough pretanning to be of significant help either with the splitting or the final tanning. On the other hand a shrinkage temperature above about 185° F after pre-tanning does not permit the pretanned product to acquire most of the desirable features of chrome-tanned leather. Tannin (vegetable) pretanning, aldehyde pretanning or pretanning with the aluminum or zirconium tanning compounds mentioned above, are generally not as desirable as the syntan pretanning, but best results are generally obtained from mixed pretans, preferably a Helatan type mixture of about ¼ to ¾ sulfonated phenol-formaldehyde pretan and the balance glutaraldehyde pretan.

Many other treatment modifications can be made in accordance with the present invention. Acetic acid can be used in place of the formic acid, as can sulfuric acid or hydrochloric acid, although sulfuric acid and hydrochloric acid are not preferred for use as the sole acidifying agent during pretanning. Other syntans can be used such as that of Example 1 in U.S. Pat. No. 3,557,078 or those described in Chapter 21 of the Chemistry of Leather Manufacture, edited by McLaughlin-Theis - published 1945 by Reinhold Publishing Corp., and in Chapter 10 of Practical Leather Technology, edited by Thomas C. Thorstensen - published 1969 by Reinhold Publishing Corp. The fat-liquoring usually supplies enough fat-liquor oil for the final leather to retain from about 6 to about 15% by weight.

Typical alternative unhairing and bating techniques are described in the above-cited texts as well as in Die Chemie der Leder Fabrikation, edited by Wilson-Strather-Gierth - published 1930 by Julius Springer Publishing, Vienna, and in publications by Dr. Peter Van Vlimmeren. These treatments are almost always used in the making of leather, but whether they are used has no bearing on the present invention other than that they can be conducted in the same treatment drum as the pretanning, without an intervening unloading of the hides from that drum. Such unloading of hides is a laborious and expensive operation, as compared to the continued operation of the drum with changes of chemicals, and is best avoided. Where it is desirable to know the weight of the hides after dehairing, the weight can be taken by using a Hide Processor Machine equipped with a scale.

The disposal of the used chrome-tanning liquor is a problem in that the unrestricted discharge of such liquor into streams, for example, and even into sewers, is generally not permitted because of the effect of such discharge on marine life as well as on groundwaters. According to the present invention such discharge is minimized without detracting from the quality of the chrome-tanned leather that is produced.

The amount of chrome-tanning chemicals used pursuant to the present invention is based on the shaved weight of the hides to be chrome-tanned, and as noted in the examples, such shaved weight is very much smaller than the original hide weight. Also the chrome-tanning of the grain does not require chrome-tanning of the split, as is required in the standard blue-split tanning operations of the prior art, and vice versa, so that there is a substantial reduction in the use of chrome-tanning chemicals for this reason.

The tanning and splitting sequence of the present invention is particularly concerned with the tanning of cattle hides and similar hides that are relatively thick and are to be converted to the high quality leather characterized by chrometanning. Goat and sheep skins are normally not split so that the foregoing sequence is not applicable to them. The quality of the chrome-tanned leathers of the present invention is paticularly high since they combine the advantages of chrome-tanning with the finer, softer and lighter features of prior art lime-split leathers.

Indeed the physical characteristics of the chrome-tanned leathers of the present invention are better than is generally available from the prior art. Thus typical slot tear tests on the chrome-tanned 2-½ to 3 ozs. grain leathers of the present invention are as high as 20 and generally at least 13, whereas for standard blue-split leathers slot tear values are generally well below 13.

Without the pre-tan of the present invention the partly treated hides tend to be damaged by the shaving equipment, even if they have been well pickled. The pre-tan sequence accordingly helps streamline the entire tanning operation into one that can be carried out with the minimum of loading and unloading of the hides into and out of drums of other treating equipment.

The pickling that helps avoid problems with subsequent splitting, is best effected at a pH as low as 3.5 or even lower. Higher pH, such as 4 or 5, can be used effectively, particularly if the hide processing is not interrupted. A thorough acidification of the partly treated hide at pH 3.5 or even better at 3, not only simplifies the splitting but places the hide, before or after splitting, in a deterioration-resistant condition suitable for interruption such as is involved in shipment to distant locations. At least one hour of tumbling at the above pH levels is needed to effect the pickling.

Used chrome-tanning liquor can be recycled to the chrome-tanning step in place of water used as float. The amount of fresh chrome-tanning chemicals can then be reduced in proportion. The total quantity of spent chrome-tanning liquor that has to be discarded when practicing the present invention is quite small and frequently zero, as when all of the used liquor is reused in the float for new tanning of grain or split.

Obviously many modifications and variations of the present invention are possible in the light of the above teachings. It is therefore to be understood that within the scope of the appended claims the invention may be practices otherwise than as specifically described.

What is claimed:

1. In the manufacture of grain and split leather from a hide, the improvement according to which the hide is subjected to a pre-tanning with an essentially chromium-free tan until its shrinkage temperature is about 170° to about 185° F, the pre-tanned hide is split to provide a pre-tanned grain intermediate and a pre-tanned split intermediate, at least one of these intermediates is shaved to give it a more uniform caliper, and the shaved intermediate is chrome-tanned into leather.

2. The combination of claim 1 in which the hide is unhaired and bated before pre-tanning, and it is also pickled.

3. The combination of claim 1 in which the shavings are discarded by dumping.

4. The combination of claim 1 in which the pre-tanning is with a syntan.

5. The combination of claim 1 in which the hide is a cattle hide, the chrome-tanned intermediate is the grain, and after chrome-tanning the grain has a slot tear of more than 13.

6. The chrome-tanned cattle hide produced by the combination of claim 5.

7. The process of shipping a hide for tanning in remote geographical locations, which process comprises pickling and pre-tanning the hide to a shrinkage temperature of from about 170 to about 185° F using an essentially chromium-free pre-tanning, and then shipping the thus treated hide.

8. The combination of claim 7 in which the hide is also shaved, split or split and shaved before the shipping.

9. The combination of claim 1 in which the chrome-tanning is applied to the grain intermediate and the split intermediate is pickled and shipped to a remote location for final tanning.

10. The combination of claim 1 in which the intermediate that is shave is pickled before shaving.

11. The combination of claim 1 in which the chrome-tanning is followed by coloring and fat-liquoring, and all operations on the shaved intermediate are carried out with that intermediate held in a container, without withdrawing the intermediate from the container between operations.

12. The combination of claim 11 in which the entire sequence of hide treating operations is carried out using two container stages; a first container stage in which the hide is unhaired, bated and pre-tanned in a container without an intervening withdrawal of the hide from that container, and a second container stage in which the pre-tanned hide is given its final tanning, coloring and fat-liquoring in a container without an intervening withdrawal of the hide from that container.

13. The combination of claim 1 in which the hide is fat-liquored to a pick-up of about ½ to about ¾% before it is split.

14. The process of preparing chrome-tanned grain leather from cattle hide in a yield at least about 3% greater than provided by the lime-splitting method, said process comprising pre-tanning the unsplit hide with an essentially chromium-free tan until its shrinkage temperature is about 170° to about 185° F, splitting the pre-tanned hide to provide a grain intermediate, shaving that intermediate, and chrome-tanning the shaved intermediate.

* * * * *

UNITED STATES PATENT AND TRADEMARK OFFICE

CERTIFICATE OF CORRECTION

PATENT NO. : 4,060,384

DATED : November 29, 1977

INVENTOR(S) : Marcel Siegler

It is certified that error appears in the above-identified patent and that said Letters Patent are hereby corrected as shown below:

Col. 1, line 26, change "ing" to --ings--.

Col. 4, line 46, change "washed" to --wash--.

Col. 5, line 62, change "not" to --now--.

Col. 6, line 11, change "to" to --or--.

Col. 7, line 13, change "phenolalkylated" to --phenol-alkylated--.

Col. 7, line 15, change "Thr" to --The--.

Col. 8, line 58, change "purpose" to --purposes--.

Col. 9, line 29, change "ad" to --and--.

UNITED STATES PATENT AND TRADEMARK OFFICE

CERTIFICATE OF CORRECTION

PATENT NO. : 4,060,384

DATED : November 29, 1977

INVENTOR(S) : Marcel Siegler

It is certified that error appears in the above-identified patent and that said Letters Patent are hereby corrected as shown below:

Col. 10, line 68, change "of" (second occurrence) to --or--.

Col. 11, line 24, change "practices" to --practiced--.

Claim 10, line 2, change "shave" to --shaved--.

Claim 13, line 2, change "1/2" to --1/4--.

Signed and Sealed this

Ninth Day of May 1978

[SEAL]

Attest:

RUTH C. MASON
Attesting Officer

LUTRELLE F. PARKER
Acting Commissioner of Patents and Trademarks